United States Patent [19]

Lenk et al.

[11] 4,304,975

[45] * Dec. 8, 1981

[54] INDUCTIVELY HEATABLE GODET

[75] Inventors: Erich Lenk; Karl Bauer, both of Remscheid, Fed. Rep. of Germany

[73] Assignee: Barmag Barmer Machinenfabrik AG, Remscheid-Lennep, Fed. Rep. of Germany

[ * ] Notice: The portion of the term of this patent subsequent to Dec. 25, 1996, has been disclaimed.

[21] Appl. No.: 106,261

[22] Filed: Dec. 21, 1979

Related U.S. Application Data

[63] Continuation-in-part of Ser. No. 842,521, Oct. 17, 1977, Pat. No. 4,180,717.

[30] Foreign Application Priority Data

Oct. 21, 1976 [DE] Fed. Rep. of Germany ..... 2647540

[51] Int. Cl.[3] ..... H05B 5/08

[52] U.S. Cl. ..... 219/10.49 A; 219/10.61 A; 219/469; 336/197

[58] Field of Search ..... 219/10.49, 10.49 A, 219/10.61 R, 10.61 A, 10.75, 469, 470, 471; 336/197; 165/58.61

[56] References Cited

U.S. PATENT DOCUMENTS

| | | | |
|---|---|---|---|
| 3,417,219 | 12/1968 | Bailey | 219/10.61 A |
| 3,448,233 | 6/1969 | Landis | 219/10.61 A |
| 3,487,187 | 6/1969 | Martens et al. | 219/10.61 A |
| 3,701,873 | 10/1972 | Bauer et al. | 219/10.61 A |
| 3,810,058 | 5/1974 | White et al. | 336/60 |
| 3,936,784 | 2/1976 | Elfgen et al. | 336/197 |
| 4,180,717 | 12/1979 | Lenk et al. | 219/10.49 A |

*Primary Examiner*—Volodymyr Y. Mayewsky
*Attorney, Agent, or Firm*—John H. Shurtleff

[57] ABSTRACT

An improved means for mounting the induction coil of an inductively heated, rotatable godet about the magnetic core thereof so as to prevent internal overheating and preferably also to avoid any movement or play between the core and the coil as caused by heat expansion and vibration during operation of the godet. The improvement comprises cooling means for cooling the laminated pack acting as the magnetic core and for thermally isolating the pack from the coil and outer godet shell or casing, said cooling means including at least one hose-like tube wound around the laminated pack with means to conduct a fluid coolant therethrough. An elastic intermediate member is preferably introduced at some point between the coil and magnetic core in order to compensate for any unequal thermal expansion of these elements in the axial and/or radial directions.

7 Claims, 5 Drawing Figures

INDUCTIVELY HEATABLE GODET

INTRODUCTION

This application is a continuation-in-part of copending application Ser. No. 842,521, filed Oct. 17, 1977, now U.S. Pat. No. 4,180,717, the disclosure of which is incorporated herein by reference as fully as if set forth in its entirety.

The present invention concerns an inductively heated godet of improved design having means for mounting the induction coil of such a godet about the laminated pack of the magnetic core element including cooling means to prevent internal overheating.

BACKGROUND OF THE INVENTION

Inductively heated godets are widely used for guiding or conveying continuous synthetic fiber yarns and the like and are particularly useful in stretching and texturizing devices for the treatment and processing of such yarns. In operation, the yarns are generally wound several times about the outer circumference of the driven outer shell or casing of the godet and heat is thereby conducted to the yarn for the purpose of, for example, plastic deformation or fixation.

Godets of this general type are characterized by an induction coil being mounted in a stationary coaxial position about a laminated magnetic core which is composed of a ferromagnetic material and which is rigidly connected to the frame of the device. A drive shaft extends coaxially through the center of the laminated pack and the rotatable casing which surrounds the induction coil and laminated pack assembly is secured to the end of this drive shaft. An example of such a godet is shown in U.S. Pat. No. 3,487,187 issued Dec. 30, 1969, the disclosure of which is incorporated herein by reference.

One significant problem in these godets has been their inability to function well at high thread treating temperatures on the order of 250° C. together with high yarn speeds. With a thread contact temperature of about 250° C. on the outer casing surface, the temperature in the winding and along the inside of the hollow shell or casing rises to 300° C. or more, and the heat developed internally of the godet causes severe damage to the laminated core pack and especially to the bearings where lubricant may be completely evaporated. Therefore, these high working temperatures have been avoided with inductively heated godets, and correspondingly low thread speeds have been required to achieve a satisfactory thermal treatment.

Another significant problem encountered with such godets, has been the loosening of the induction coil from the iron core of the laminated pack in operation. This problem is caused by the differing coefficients of thermal expansion of the material used for the coil (e.g. tin, aluminum, or copper) and the material used for the laminated pack (e.g. iron). This problem is particularly acute at high operating speeds where the yarn is conveyed at speeds of 4,000 m/min. and more. At such high speeds, slight vibrations created in the godet become significant and may result in an axial shift and wear of the coil.

SUMMARY OF THE INVENTION

It is the primary object of the present invention to overcome these problems so as to permit the use of high yarn or thread speeds above about 4,000 m/min. and correspondingly high treatment temperatures of about 250°-300° C. A specific object of the invention is to provide a secure mounting of the laminated core pack while also surrounding it with an effective cooling means to rapidly draw off heat generated in the shell or casing and preventing passage of this heat through the core pack into the shaft and bearings of the godet. Yet another object is to provide satisfactory means for securing the induction coil of such godets about the magnetic core in such a manner that thermal expansion of these elements and vibration will not cause the coil to loosen during operation of the device.

The problem of overheating has been solved, in accordance with the invention by providing a cooling means in the form of at least one hose-like cooling tube having inlet and outlet ends for conducting a fluid coolant therethrough, this tube being located between the laminated core pack and the induction coil as a layer of side by side windings wrapped around and on the laminated core pack. Suitable means are included to supply a fluid coolant under sufficient pressure at the inlet end of the cooling tube to circulate the fluid coolant as a heat-exchange medium. In a preferred embodiment, two hose-like cooling tubes are guided side by side in the layered winding. The tubes are best mounted or positioned in one or more radially recessed circumferential grooves of the laminated core pack. These individual grooves at spaced axially positions are separated by a radially projecting bar or separator means which is preferably an integral part of the laminated core pack. The depth of each circumferential groove in this laminated pack is preferably approximately equal to the radially measured width of the layered tube winding.

These fluid-conducting tubes may have a circular or preferably a rectangular cross-section and should be made of a material resistant to the required high temperatures on the order of 300° C. The use of a flexible hose material is expecially favorable, e.g. a fluorinated elastomer resistant to such high temperatures, especially polyvinyl hexafluoropropylene.

It is also advantageous for purposes of the invention to place an elastic intermediate piece between the induction coil and the laminated pack in order to compensate for any unequal thermal expansion of these elements. In assembly, the coil is slipped onto the elastic intermediate piece which is positioned about the laminated pack as a part of the cooling means, and the coil is then secured against axial shifting. As a result, the coil is sufficiently secured, such that, even when heat expansion of the elements occurs during operation of the device and without any further compensating measures, there is no longer any danger of damaging the coil. Furthermore, the elastic intermediate piece when associated with the cooling means, serves partly as an insulator to reduce the amount of heat passed to the godet bearings due to heat loss through the coil, thereby increasing the service life of these bearings.

Assembly and disassembly of the induction coil may be significantly simplified by providing an elastic intermediate member that can be externally expanded by the radial expansion of the flexible hose-like cooling tube or tubes. These tubes may be separate from or integral with the elastic intermediate member. Such construction makes it possible to easily replace the coil without danger of damaging any component parts for such purposes as, for example, changing the installed heating output.

Constructing the elastic intermediate member as a separate sleeve or circumferential layer around the cooling tube or tubes permits a number of advantageous design variations. This elastic member may also be introduced as a molded elastomer in and/or around the cooling tube or tubes at selected circumferential positions sufficient to firmly hold the coil during heat expansion or contraction. In another embodiment, the induction coil can be radially supported directly on the projections or support bars which define the grooves of the laminated pack, preferably using end support members such as annular rings at either end of the coil to prevent axial movement of the coil.

In each embodiment of the invention, the individual hose-like cooling tubes are connected to a coolant circuit which is under pressure sufficient to circulate the fluid coolant, preferably water. Thus, in this simple manner, the godet bearings are effectively protected against the deleterious effects of heat while at the same time the coil is reliably secured to the laminated pack during operation of the device.

THE DRAWINGS

The invention is illustrated by the accompanying drawings in which.

Figure 4:
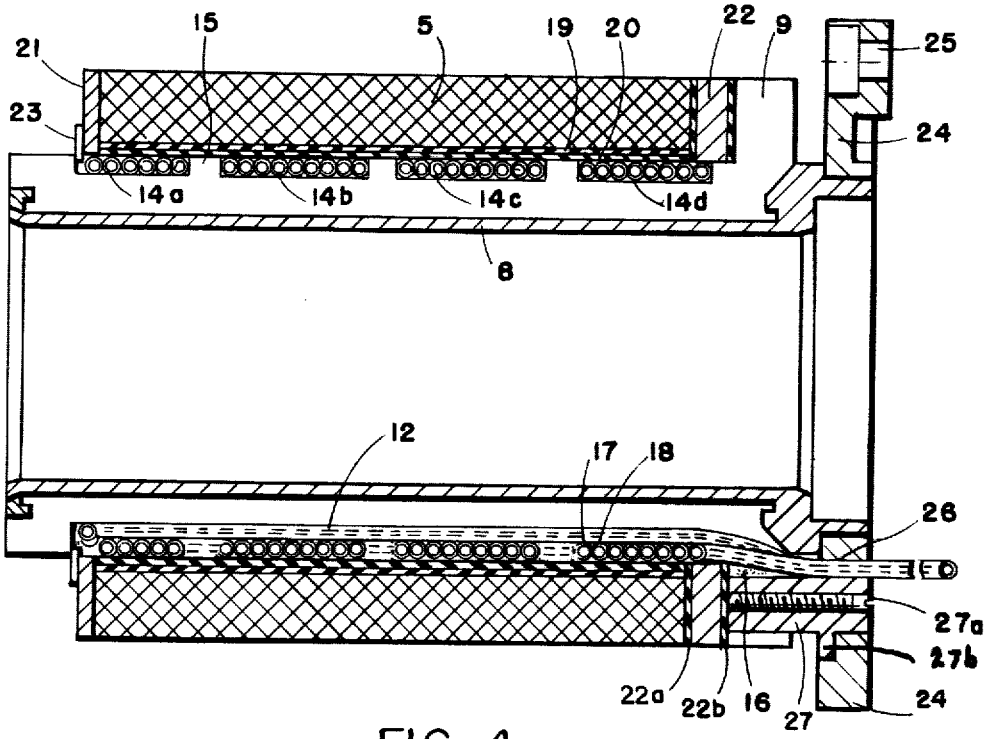
Figure 5:
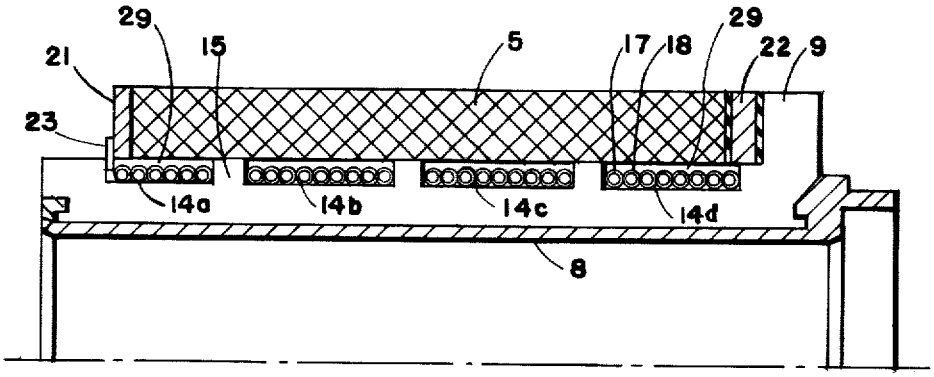

FIG. 4 is a schematic longitudinal section taken through another preferred godet of the invention illustrating a separate insertion of one or more elastic intermediate members as an outer layer or sleeve over the cooling tubes; and FIG. 5 is a schematic longitudinal section of the upper segment of another godet similar to the structure of FIG. 4 but with deeper grooves to create an air-insulating gap between the cooling tubes and the induction coil.

DESCRIPTION OF THE PREFERRED EMBODIMENTS

Figure 1:
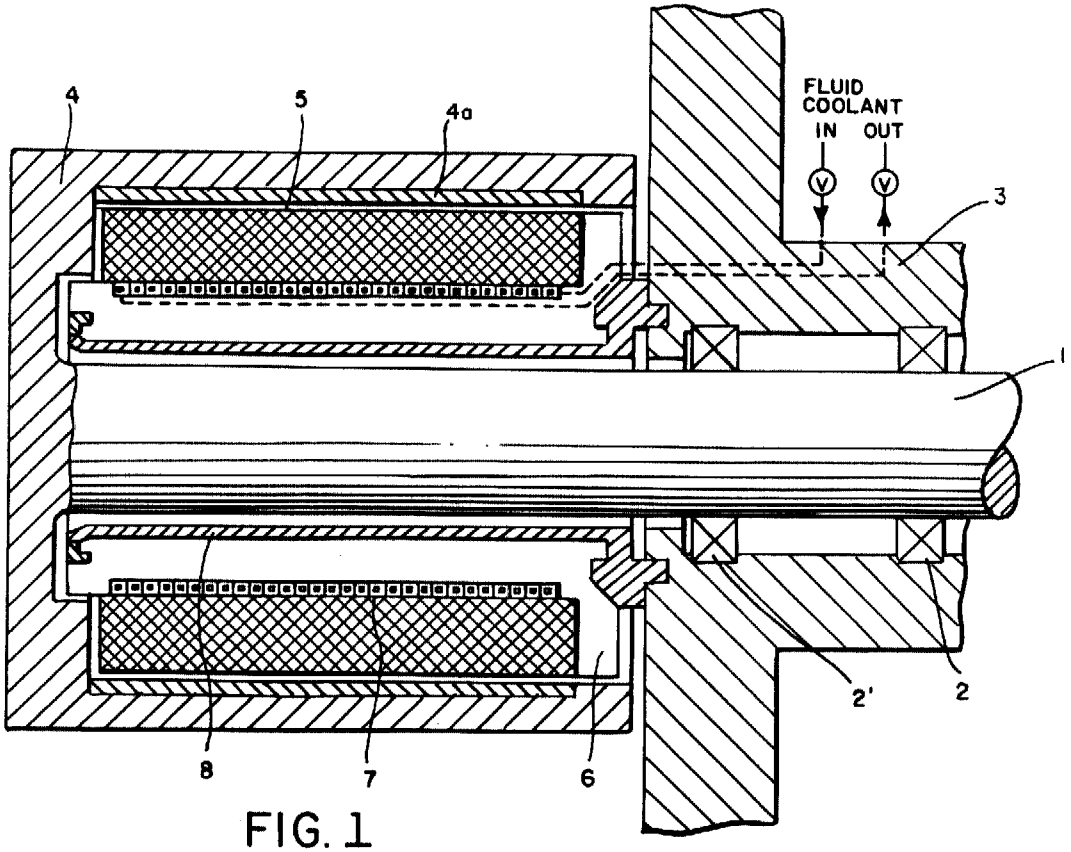
FIG. 1 illustrates a schematic longitudinal section through an inductively heated godet constructed from the fewest number of elements capable of yielding the improvement of the present invention.

Referring to the drawings, in the generally required arrangement for a cooled godet of the invention according to FIG. 1, the godet drive shaft 1 rests in two ball bearing assemblies 2 and 2' mounted in the frame 3 of the machine. It is also possible to support this godet drive shaft 1 in a bearing housing or in a universal ball joint which is then secured to the machine frame 3.

The end of godet shaft 1 within machine frame 3 is driven by a motor (not shown) and the other front, free end of the shaft carries the godet shell or casing 4 upon which a synthetic fiber thread or yarn may be wound. A secondary induction coil in the form of a copper bushing **4*a* is secured to the inner surface of the hollow casing 4 to regulate the development of heat over the surface of the godet. Mounted between rotatable casing 4 and drive shaft 1 are a primary coil 5 and laminated pack 6, these members being firmly secured to a carrier 8 which is fixed on the machine housing 3. The elastic intermediate member 7 of the invention, which in this case is a flexible, elastomeric, helically wound cooling tube, is located between coil 5 and laminated pack 6. Coil 5 is supported here solely by the elastic intermediate member 7**.

In mounting the induction coil 5, which is supplied as a unitary, finished package, upon the laminated pack 6, the intermediate elastic member 7 is compressed and coil 5 is then pushed over it. The inward pressure on the intermediate member is then relieved and it expands to secure the coil upon the laminated pack.

During operation of the godet, the coil and laminated pack will expand due to the inductive heating of the assembly. The coil and laminated pack are made of different materials so that their expansion due to heating will also be different. Since the coil is solely supported upon laminated pack 6 by the elastic intermediate member 7, this intermediate member will completely compensate for differences in expansion so as to secure the coil to the laminated pack at all times without play.

In this first disclosed embodiment of the invention, the elastic intermediate member 7 is constructed of a hose-like hollow chamber rather than a solidly formed elastic body. In such an embodiment, the hose is expanded under pressure when filled with a coolant in order to secure the coil about the laminated pack. The assembly is connected to a coolant circuit as indicated by the two valves V so that circulation therethrough is maintained. This construction is advantageous because the heat transfer to the godet drive shaft 1 is blocked, or at least sharply restricted, thereby substantially reducing the amount of heat carried to the shaft bearings 2 and 2'. This makes it possible to move the bearing 2' outwardly toward the free end of the shaft so as to reduce the length of shaft projecting beyond this bearing. In this manner, the godet assembly is made more resistant to vibration and the load demands on the bearings are also significantly reduced.

Figure 2:
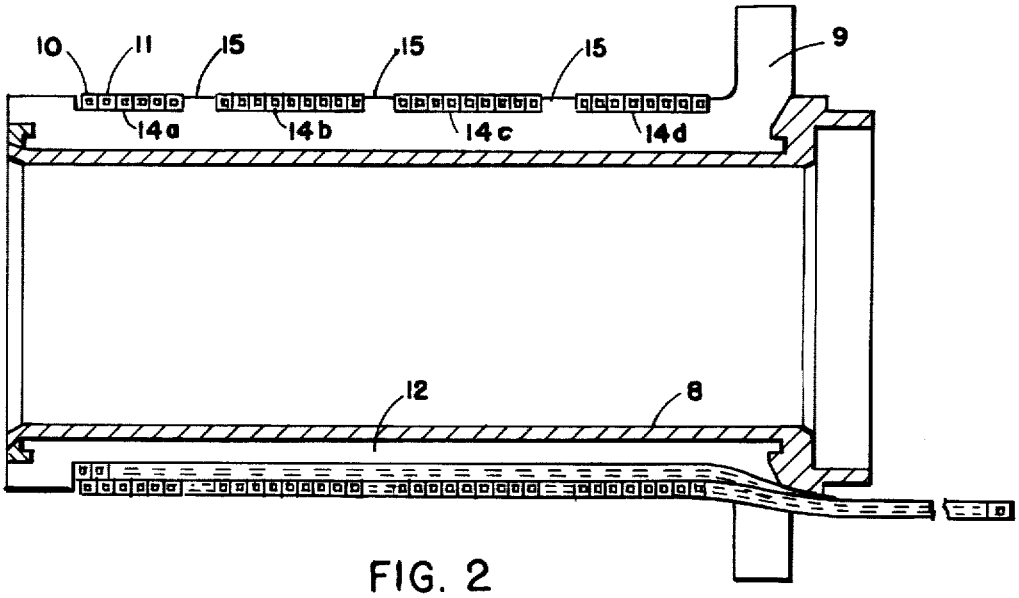
FIG. 2 is a schematic longitudinal section taken vertically through the axis of a preferred godet according to the invention, the induction coil being omitted to illustrate the use of two cooling tubes arranged in a series of grooves axially spaced along the laminated core pack.
Figure 3:
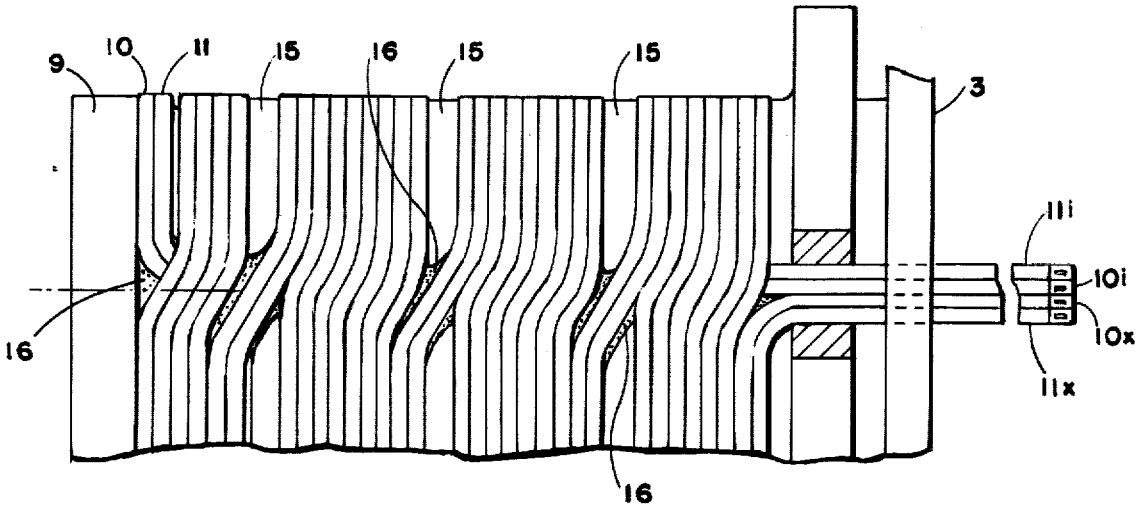
FIG. 3 is a partial bottom plan view of the godet of FIG. 2 to illustrate the arrangement of the cooling tubes in the grooves.

An especially preferred arrangement of two cooling tubes wound side by side is illustrated in FIGS. 2 and 3 where the individual hollow tubes have a square or rectangular cross-section and act as elastic supporting members for the induction coil (not shown). In this case, the carrier 8 is connected to the machine frame 3 shown partly in FIG. 3 so as to hold the laminated pack 9 in a fixed position with the two hollow cooling tubes 10 and 11 wound thereon. The inlet ends **10*i* and 11*i* of these two cooling tubes enter from the machine frame 3 into a deeply recessed axial groove 12 of the laminated pack 9 so as to extend up to the forward or outer projecting end of this pack and are then helically coiled back over these inlet ends in a layer of tube windings positioned in the circumferential grooves 14*a*, 14*b*, 14*c* and 14*d*. These four circumferential grooves of the laminated pack are separated from each other by the projections or bars 15, each having an oblique opening 16 in its circumference to guide the pair of tubes from one groove to the next. These openings are advantageously filled with a heat-resistant silicone rubber which may also be used to fill in other open spaces around the tubes, thereby assisting in holding the tubes in place and preventing movement or play on the laminated pack. The exit or outlet ends 10*x* and 11*x* of the hollow tubes return from the inner end of the pack through the machine frame, and coolant such as water is continuously circulated in direct contact with the laminated pack 9**.

In FIGS. 2 and 3, the square or rectangular tubes 10 and 11 project just slightly beyond the outer circumferential portions 15 of the laminated pack 9 (exaggerated in FIGS. 2 and 3) so as to be in direct supporting contact with an induction coil which can be slipped thereon when the tubes have been drained of coolant. Once the induction coil is in place, the coolant is introduced and circulated under sufficient pressure to slightly expand the tubes and firmly grip the interior circumferential portion of the induction coil.

The embodiment of FIG. 4 provides another example of winding two side by side hollow cooling tubes. In this case the tubes 17 and 18 have a circular cross-section but are introduced and wound in the same type of axial groove 12 and circumferential grooves 14 as shown in FIG. 2. The width or radial thickness of the layer of helically wound tubes is approximately equal to the depth of the circumferential grooves 14 as defined by the projections 15. Two intermediate elastic sleeves 19 and 20 are drawn over the laminated pack and the hollow tubes nested in their grooves so as to form a protective insulating and elastic supporting layer which prevents axial and radial play of the induction coil 5 mounted thereon as the godet is heated to high temperatures. The coil 5 may also be positioned by the use of the annular end members 21 and 22, for example, to permit coils of different lengths to be inserted, the outer end 21 preferably being fixed in place by a locking washer 23 or the like.

The carrier 8 in FIG. 4 is fixed to a circular mounting plate 24 which in turn is readily bolted to the machine frame at a number of bolt positions 25 while providing a suitable opening 26 for the inlet and outlet ends of the cooling tubes. This opening 26 may also receive a wedge-shaped member 27 replacing a small segment of the laminated pack and having set screw **27*a* which pushes against the annular end member 22 bearing thin rubber faces 22*a* and 22*b* with enough force to prevent any axial movement of the coil 5. The key lock 27*b* of wedge 27 fits into plate 24 to position and brace the wedge against the screw pressure. Again, any empty spaces in or around the tubes can be filled with silicone rubber 16** or the like.

The embodiment of FIG. 5 illustrates another preferred variation similar to FIG. 4 but with the paired hollow tubes 17 and 18 being set into deeper circumferential recesses 28 in the laminated pack 9, thereby providing an insulating air gap 29 between these tubes and the induction coil 5. The coil 5 is supported directly on the projections 15 of the laminated pack, and axial movement of the coil 5 is prevented in a satisfactory manner by the rubber or elastic faced end member 22. Such end members when wedged or compressed in place are generally very satisfactory means of preventing both axial and radial play of the coil.

Alternatively, the circumferential air gap spaces 29 between the pack and the coil as shown in FIG. 5 can receive individual elastic sleeves, for example using a narrow sleeve band only near the inner and outer ends of the grooved pack. All of these sleeves, bands, or other elastic intermediate members used for tensioning or gripping the induction coil during operation of the godet are preferably made of one of conventional rubber or elastomeric materials known to be very heat-resistant.

The flexible hoses used as hollow tubes are preferably composed of a fluoro-substituted elastomer such as polyvinyl hexafluoropropylene, e.g. obtainable under the trademark "Viton". However, other heat-resistant materials may also be used, especially in the embodiments of FIGS. 4 and 5 where the tubes are not used to provide the main support for the induction coil. Also, in place of intermediate elastic sleeves or hose-like supports, it is possible to cast or pour a moldable and curable elastomeric compound such as a silicone polymer into and around the individual hoses or tubes, thereby preventing any loosening or undesirable axial and radial play at high temperatures.

While several particular embodiments of the present invention have been shown and described, it should be understood that various obvious changes and modifications thereto may be made by those skilled in the art, and it is therefore intended in the following claims to include all such changes and modifications as may fall within the spirit and scope of this invention.

The invention is hereby claimed as follows:

1. In an inductively heated godet of the type wherein a drive shaft projecting outwardly from its support on a machine frame drives a rotatable hollow casing which is secured to the outer end of the drive shaft and wherein a heating device is located between the drive shaft and casing on the machine frame, the heating device including a primary induction coil placed about a stationary laminated pack of ferromagnetic material and a secondary induction coil secured to the inner surface of the hollow casing, the improvement comprising:

cooling means for cooling the laminated pack and thermally isolating said pack from said induction coil and said casing, said cooling means including at least one hose-like cooling tube having inlet and outlet ends for conducting a fluid coolant therethrough, said tube being located between said laminated pack and said coil and being wrapped in a layer of side by side windings around and on said laminated pack;

means to supply a fluid coolant under pressure to the inlet end of said tube; and means to withdraw said fluid coolant from the outlet end of said tube.

2. An improved inductively heated godet as claimed in claim 1 wherein said cooling tube is a flexible hose material made of a fluorinated elastomer resistant to high temperatures on the order of 300° C.

3. An improved inductively heated godet as claimed in claim 2 wherein said hose material is made of polyvinyl hexafluoropropylene.

4. An improved inductively heated godet as claimed in claim 1 wherein one end of said cooling tube is positioned in a recessed groove of said laminated pack, said groove extending parallel to the godet axis from the outer projecting end of the pack to the other inner end adjacent the machine frames, such that the layer of tube windings also surrounds the tube end positioned in said groove.

5. An improved inductively heated godet as claimed in claim 4 wherein said laminated pack contains at least two recessed circumferential grooves axially separated by a radially projecting bar therebetween, said circumferential grooves being occupied by at least one cooling tube in a layered winding and said projecting bar having an opening in its circumference to guide said at least one tube from one circumferential groove to the other.

6. An improved inductively heated godet as claimed in claim 5 having two cooling tubes guided side by side in said layered winding.

7. An improved inductively heated godet as claimed in claim 1, 2, 3, 4, 5 or 6 wherein said cooling tube or tubes are constructed with a rectangular cross-section.

* * * * *